US006913561B2

(12) United States Patent
Wu et al.

(10) Patent No.: US 6,913,561 B2
(45) Date of Patent: Jul. 5, 2005

(54) STATIONARY APPARATUS FOR DOING EXERCISE IMITATING THE ACT OF MOUNTAIN CLIMBING

(76) Inventors: Dong-Her Wu, No. 141, Sec. 2, Chang Shui Road, Pu Yen Hsiang, Chang Hua Hsien (TW); Lai-Fu Tang, No. 112, Lane 80, Jianping 6th Street, Anping District, Tainan City (TW)

( * ) Notice: Subject to any disclaimer, the term of this patent is extended or adjusted under 35 U.S.C. 154(b) by 0 days.

(21) Appl. No.: 10/683,991

(22) Filed: Oct. 14, 2003

(65) Prior Publication Data

US 2005/0079959 A1 Apr. 14, 2005

(51) Int. Cl.[7] ..... A63B 22/04
(52) U.S. Cl. ..... 482/52; 482/80
(58) Field of Search ..... 482/51–53, 79–80, 482/112–113, 111

(56) References Cited

U.S. PATENT DOCUMENTS 5,230,675 A * 7/1993 Lin ..... 482/53
5,545,111 A * 8/1996 Wang et al. ..... 482/53
5,746,681 A * 5/1998 Bull ..... 482/53
6,102,833 A * 8/2000 Chen ..... 482/53
6,315,697 B1 * 11/2001 Chen ..... 482/53

* cited by examiner

*Primary Examiner*—Stephen R. Crow
(74) *Attorney, Agent, or Firm*—Alan D. Kamrath; Nikolai & Mersereau, P.A.

(57) ABSTRACT

A stationary exercise apparatus includes a framework, a curved shaft, two oil pressure cylinder sets, and two pedals. The curved shaft has two curved ends and a straight portion located between the two curved ends. The two curved ends are pivoted with the framework such that the two curved ends form a deflection angle of 180 degrees when the curved shaft is driven to turn radially. The two oil pressure cylinder sets are fastened between the framework and the curved ends of the curved shaft for providing the curved shaft with a damping effect. The two pedals are mounted on the straight portion of the curved shaft for driving the curved shaft to turn radially.

4 Claims, 7 Drawing Sheets

STATIONARY APPARATUS FOR DOING EXERCISE IMITATING THE ACT OF MOUNTAIN CLIMBING

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an exercise machine, and more particularly to a stationary apparatus which is designed for doing exercise that imitates mountain climbing.

BACKGROUND OF THE INVENTION

The mountain climbing is an exercise that some people are very fond of. However, people living in the urban areas do not have time or easy access to a mountain climbing site. It is therefore conceivable that a stationary apparatus for doing the indoor mountain climbing exercise is a welcome alternative for those who are fond of the mountain climbing.

BRIEF SUMMARY OF THE INVENTION

The primary objective of the present invention is to provide a cost-effective machine for doing exercise imitating mountain climbing.

It is another objective of the present invention to provide an exercise machine which has the dual purpose of imitative mountain climbing exercise and rehabilitative exercise.

In keeping with the principle of the present invention, the foregoing objectives of the present invention are attained by a stationary apparatus comprising a frame, a curved shaft, two oil pressure cylinder sets, and two pedals. The curved shaft has two curved ends which are pivoted to the frame such that the two curved ends form a deflection angle of 180 degrees when the curved shaft is turned. The two oil pressure cylinder sets are respectively fastened between the frame and the curved ends of the curved shaft for providing the curved shaft with a damping effect. The two pedals are fastened with a straight portion of the curved shaft for actuating the curved shaft to turn.

The features and the advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
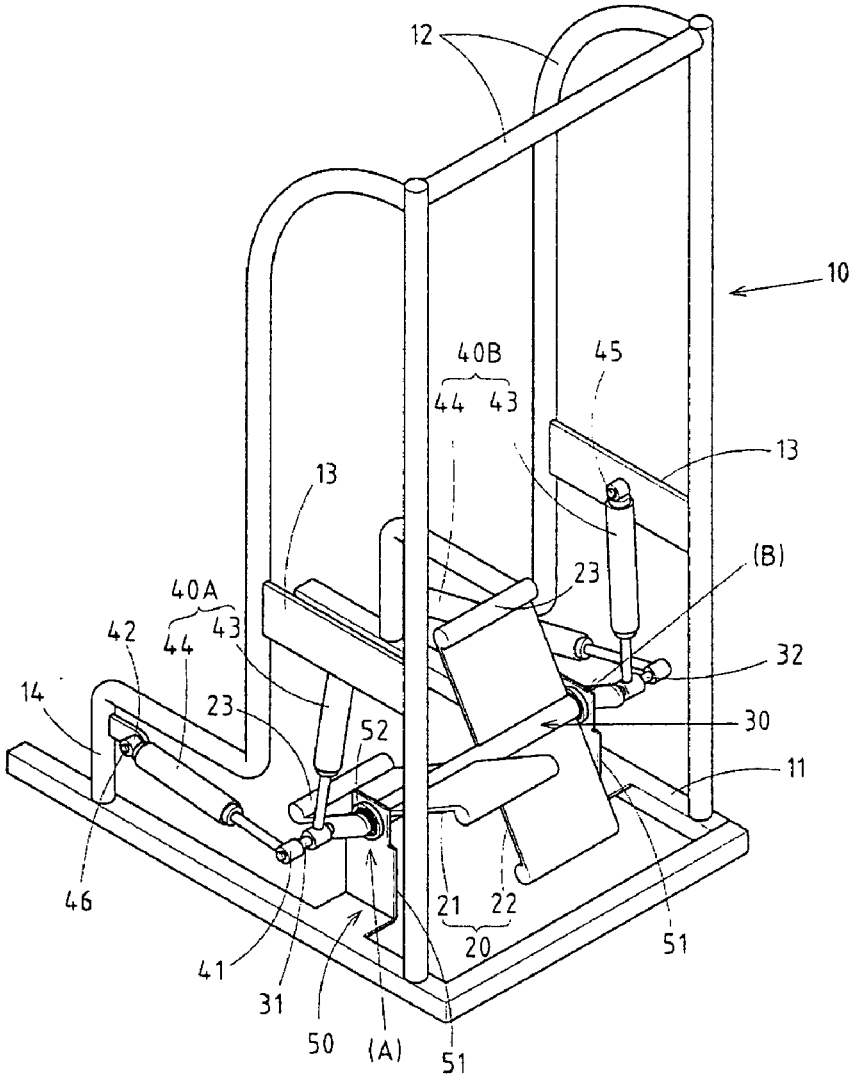
FIG. 1 shows a perspective view of a first preferred embodiment of the present invention.
Figure 2:
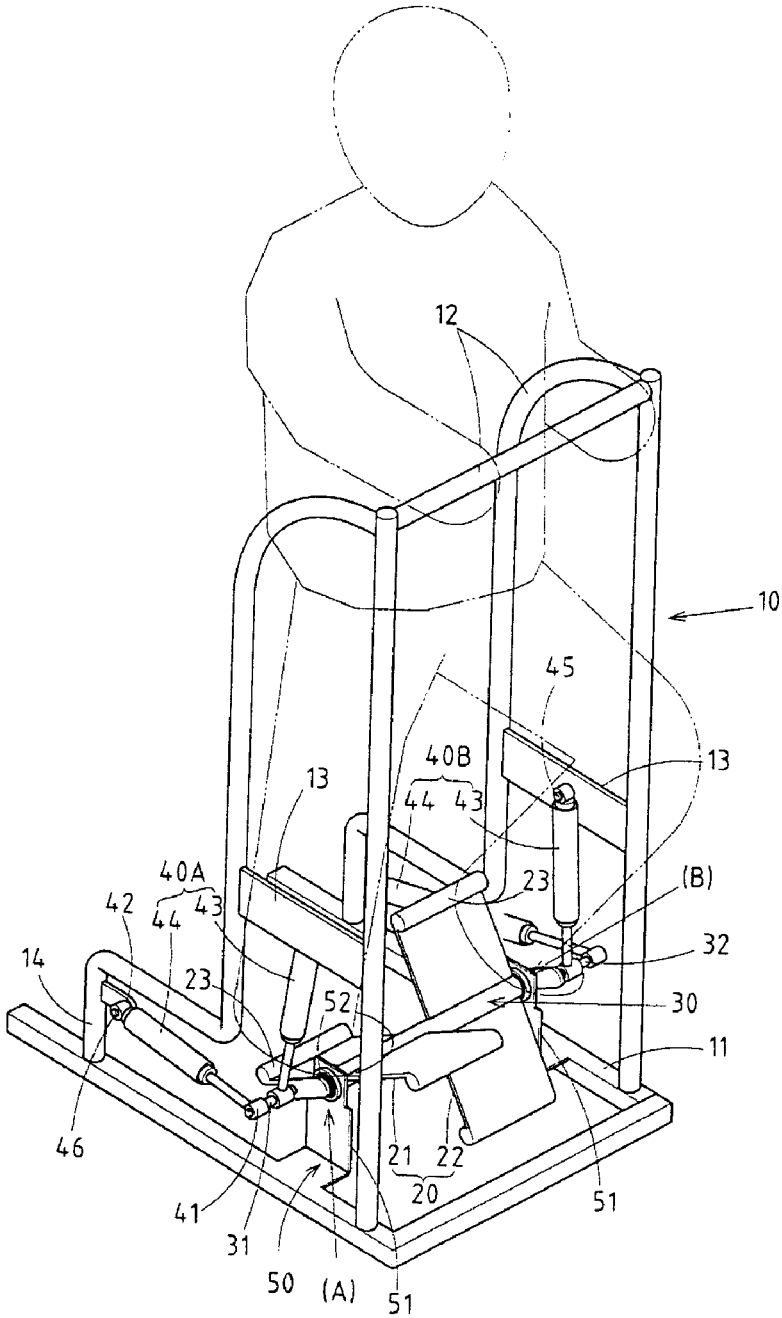
FIG. 2 shows a schematic view of the first preferred embodiment of the present invention in operation.
Figure 3:
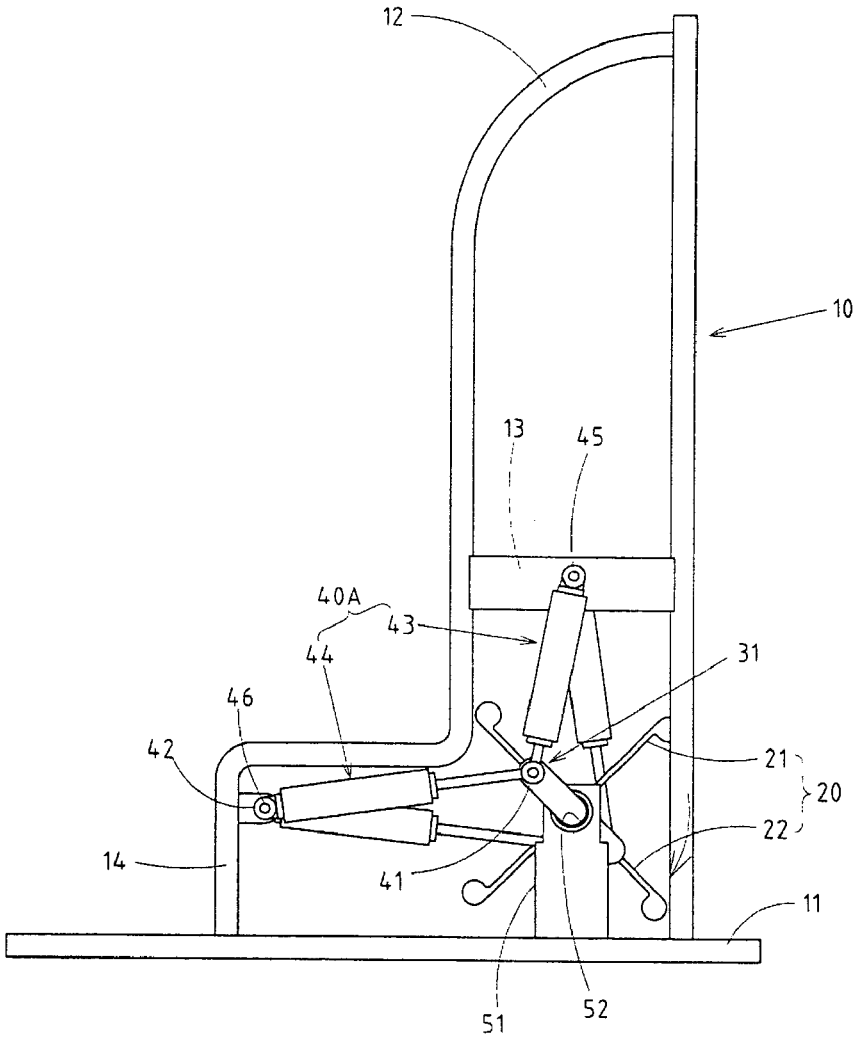
FIG. 3 shows a side schematic view of the first preferred embodiment of the present invention in action.
Figure 4:
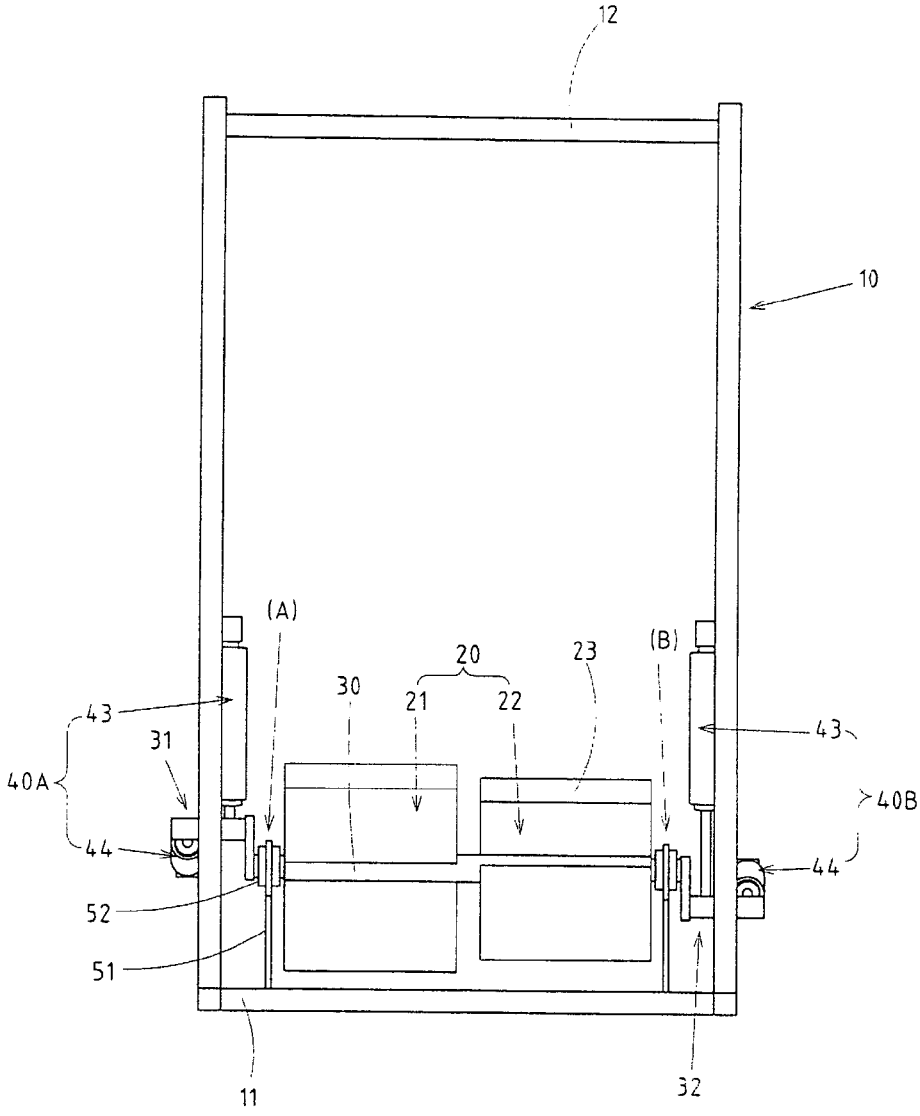
FIG. 4 shows a front view of the first preferred embodiment of the present invention in action.
Figure 5:
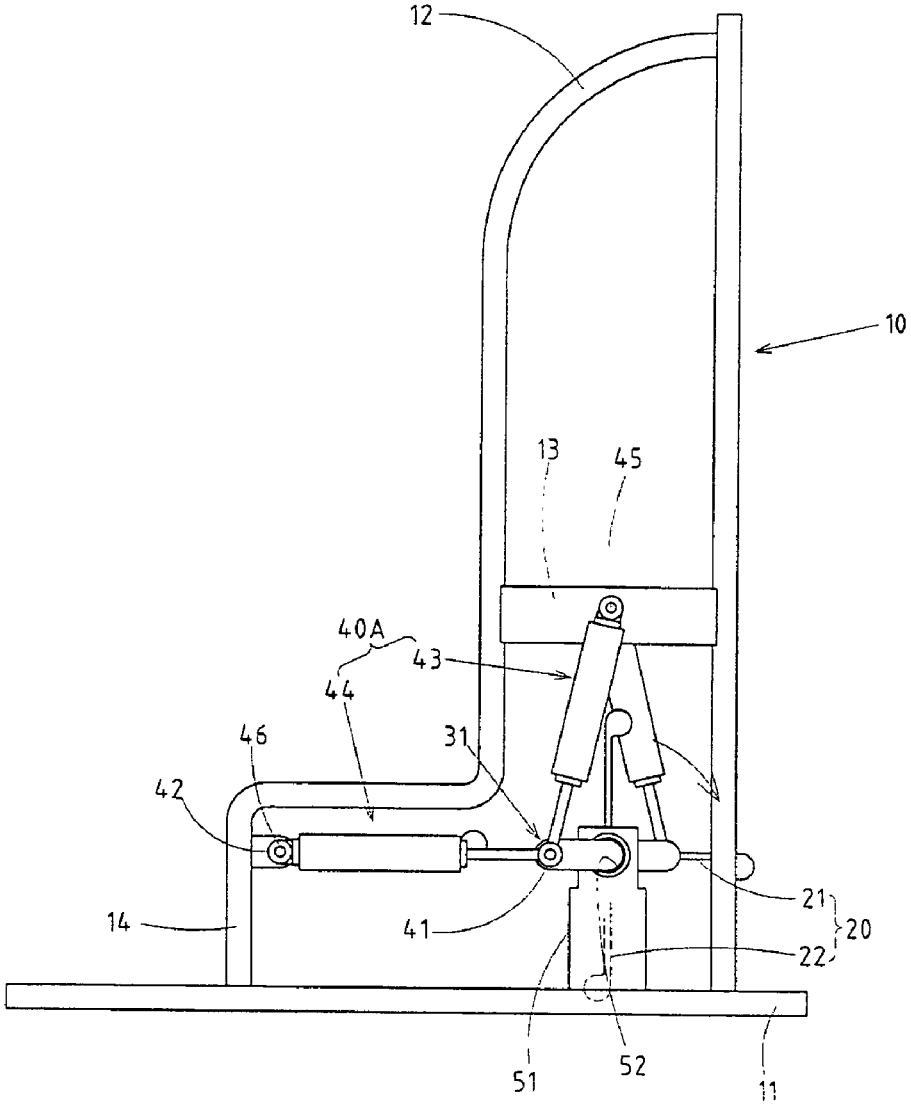
FIG. 5 shows another side schematic view of the first preferred embodiment of the present invention in action.
Figure 6:
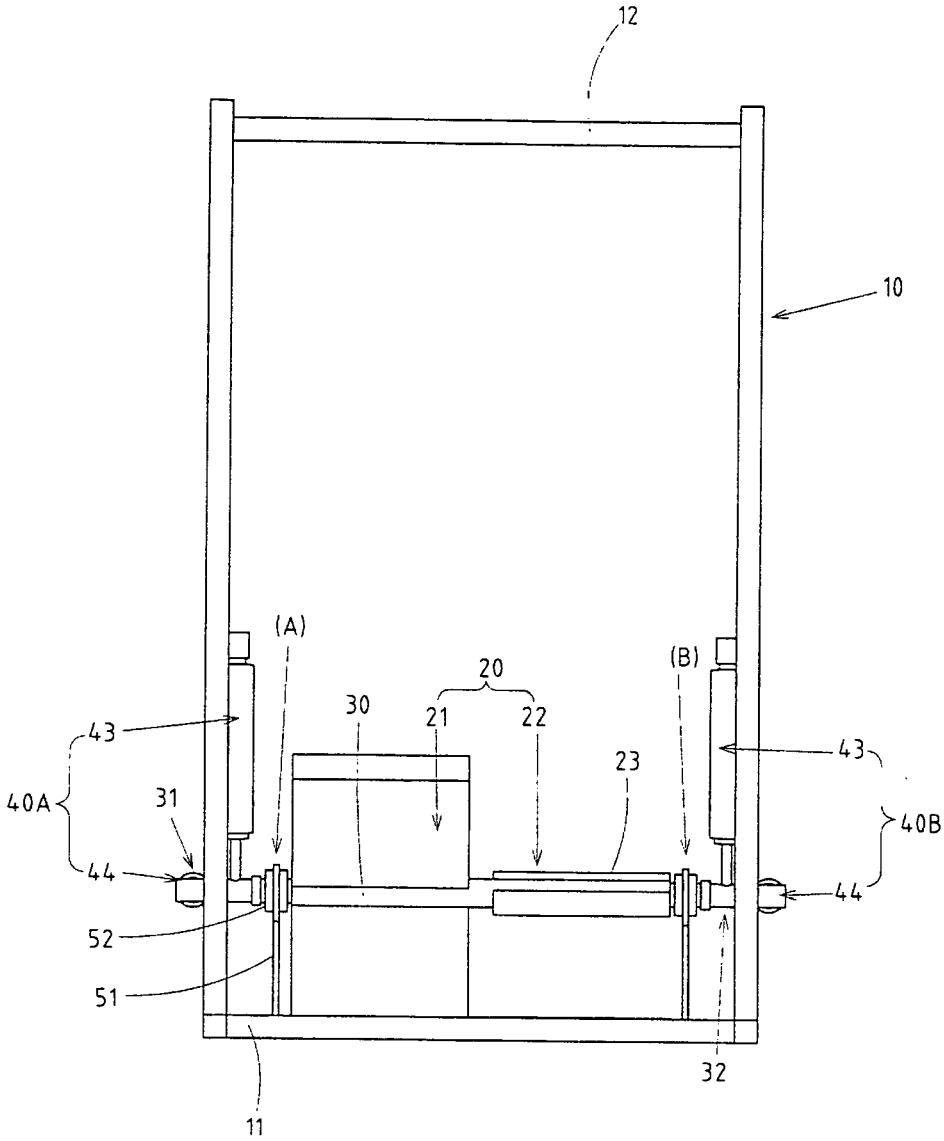
FIG. 6 shows another front view of the first preferred embodiment of the present invention in action.

As shown in FIGS. 1–6, a stationary apparatus embodied in the present invention is designed to enable a user thereof to do an exercise imitating the mountain climbing. The stationary apparatus comprises a frame 10, two pedals 21 and 22, a curved shaft 30, and two oil pressure cylinder sets 40A and 40B.

The frame 10 comprises a base 11, two hand grips 12, two horizontal plates 13 parallel to the base 11 which is rested on a floor surface, and two upright rods 14 perpendicular to the base 11.

The curved shaft 30 has two curved ends 31 and 32, which are curved in opposite directions. The first curved end 31 is pivoted with the frame 10 in conjunction with the first oil pressure cylinder set 40A such that the first curved end 31 is fastened to the first horizontal plate 13 and a first upright rod 14 of the frame 10. Similarly, the second curved end 32 is pivoted with the frame 10 in conjunction with the second oil pressure cylinder set 40B such that the second curved end 32 is fastened to the second horizontal plate 13 and the second upright rod 14 of the frame 10. The oil pressure cylinder sets 40A and 40B serve to provide the curved shaft 30 with a damping effect when the curved shaft 30 is driven to turn radially.

The two pedals 21 and 22 are fastened side by side with a straight portion of the curved shaft 30. The straight portion is located between the two curved ends 31 and 32 of the curved shaft 30. As the two pedals 21 and 22 are exerted on by an external force, the curved shaft 30 is driven to turn radially, with the two curved ends 31 and 32 having a deflection angle of 180 degrees.

The base 11 of the frame 10 is provided with two support bodies 50 corresponding in location to the two curved ends 31 and 32 of the curved shaft 30. The support bodies 50 are of an L-shaped construction and have an upright portion 51 which is provided at the top end with a bearing 52. The bearings 52 serve as supporting parts for the two curved ends 31 and 32 of the curved shaft 30.

The two pedals 21 and 22 of the pedaling structure 20 are provided with one or more skidproof portions 23.

The first oil pressure cylinder set 40A and the second oil pressure cylinder set 40B are formed of an upright cylinder 43 and a horizontal cylinder 44. The upright cylinder 43 and the horizontal cylinder 44 have an expansion end 41 and a cylinder end 42. The expansion end 41 is fastened with the curved end 31 or 32. The cylinder end 42 of the upright cylinder 43 is fastened with the horizontal plate 13 by a first pivot 45. The cylinder end 42 of the horizontal cylinder 44 is fastened with the upright 14 by a second pivot 46.

In operation, the curved shaft 30 is driven by the two pedals 21 and 22 to turn radially. Meanwhile, the curved ends 31 and 32 of the curved shaft 30 are provided with a damping effect by the oil pressure cylinder sets 40A and 40B, thereby resulting in an exercise imitating the mountain climbing.

Figure 7:
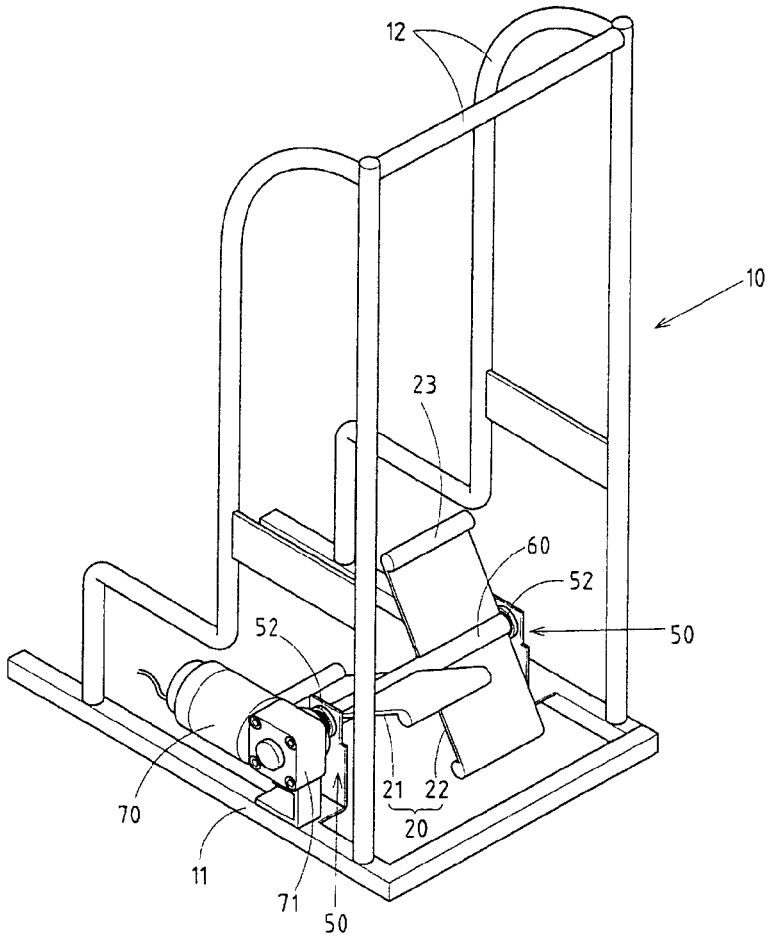
FIG. 7 shows a perspective view of a second preferred embodiment of the present invention.

As shown in FIG. 7, an electric stationary apparatus of the second preferred embodiment of the present invention comprises a frame 10, a pedaling structure 20 formed of two footrests 21 and 22, a straight shaft 60 on which the two footrests 21 and 22 are mounted, a drive motor 70 mounted on a base 11 of the frame 10, and a deceleration gear set 71 mounted on the base 11 of the frame 10.

The straight shaft 60 is supported by two support plates 50 which are mounted uprightly on the base 11 of the frame 10 and are provided with a bearing 52 serving as a supporting part. One end of the straight shaft 60 is connected with an output end of the deceleration gear set 71. The straight shaft 60 is driven to turn radially by the drive motor 70 via the deceleration gear set 71. As the straight shaft 60 is driven to turn, the two footrests 21 and 22 are actuated to turn along with the straight shaft 60. The electric stationary apparatus of the present invention is designed for a recuperating person to do rehabilitative exercise. The frame 10 comprises two hand grips 12. The two footrests 21 and 22 are provided with at least one skidproof portion 23.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

What is claimed is:

1. A stationary exercise apparatus comprising:

a framework comprising two hand grips and a base in contact with a surface on which said exercise apparatus is located;

an oil pressure cylinder set attached to said framework;

a curved shaft comprising a first curved end, a second curved end, and a straight portion located between said first curved end and said second curved end whereby said first curved end and said second curved end are pivotally fastened to said framework in conjunction with an oil pressure cylinder set such that said first curved end and said second curved end form a deflection angle of 180 degrees at the time when said curved shaft is driven to turn radially; and two pedals mounted side by side on said straight portion of said curved shaft whereby said two pedals drive said curved shaft to turn radially at the time when said two pedals are exerted on by said external force.

2. The stationary exercise apparatus as defined in claim 1, wherein said base of said framework is comprised of two supporting members for supporting said two curved ends of said curved shaft whereby said two supporting members are provided with a bearing in which said curved shaft revolves.

3. The stationary exercise apparatus as defined in claim 1, wherein said framework comprises two horizontal plates opposite to each other and parallel to said base, and two upright rods opposite to each other and perpendicular to said base; wherein said oil pressure cylinder set is comprised of an upright oil pressure cylinder and a horizontal oil pressure cylinder, said upright oil pressure cylinder being pivoted at one end with one of said two horizontal plates and fastened at another end to one of said two curved ends of said curved shaft, said horizontal oil pressure cylinder being pivoted at one end with one of said two upright rods and fastened at another end to the one of said two curved ends of said curved shaft.

4. The stationary exercise apparatus as defined in claim 1, wherein said two pedals are comprised of one or more skidproof portions.

* * * * *